US006922913B2

(12) United States Patent
Hood et al.

(10) Patent No.: US 6,922,913 B2
(45) Date of Patent: Aug. 2, 2005

(54) VOLATILIZABLE MEDIA HOLDER FOR A LAUNDRY DRYER

(75) Inventors: Lisa J. Hood, Newton, IA (US); Troy A. Johnson, Newton, IA (US); Joseph M. Keeler, Colfax, IA (US); Paul E. Maass, Naperville, IL (US); Jeffrey D. Rupe, Ankeny, IA (US); Dean L. Schaffran, Newton, IA (US); Stephen D. Schober, Newton, IA (US); Curtis J. Tremel, Newton, IA (US)

(73) Assignee: Maytag Corporation, Newton, IA (US)

( * ) Notice: Subject to any disclaimer, the term of this patent is extended or adjusted under 35 U.S.C. 154(b) by 11 days.

(21) Appl. No.: 10/642,202

(22) Filed: Aug. 18, 2003

(65) Prior Publication Data

US 2005/0050762 A1 Mar. 10, 2005

(51) Int. Cl.[7] ..... F26B 11/02
(52) U.S. Cl. ..... 34/595; 34/597; 34/603
(58) Field of Search ..... 34/595, 597, 603, 34/604, 202, 239

(56) References Cited

U.S. PATENT DOCUMENTS

| | | | | |
|---|---|---|---|---|
| 2,139,404 A | | 12/1938 | Evans | |
| 2,417,397 A | | 3/1947 | McCarthy | |
| 3,417,481 A | | 12/1968 | Rumsey, Jr. | |
| 3,435,537 A | | 4/1969 | Rumsey, Jr. | |
| 3,744,402 A | * | 7/1973 | Piegza et al. | 99/360 |
| 3,805,561 A | | 4/1974 | Bullock | |
| 3,877,152 A | | 4/1975 | Gorman | |
| 4,091,548 A | * | 5/1978 | Daily | 34/600 |
| 4,109,397 A | * | 8/1978 | Daily | 34/239 |
| 4,682,424 A | | 7/1987 | Irving | |
| 4,941,270 A | | 7/1990 | Hoffman | |
| 5,369,892 A | | 12/1994 | Dhaemers | |
| 5,478,505 A | | 12/1995 | McElfresh et al. | |
| 5,546,678 A | | 8/1996 | Dhaemers | |
| 5,698,166 A | | 12/1997 | Vick et al. | |
| 5,713,137 A | | 2/1998 | Fujita | |
| 5,743,025 A | * | 4/1998 | Jordan, Jr. | 34/600 |
| 5,755,040 A | | 5/1998 | Ou | |
| 5,776,378 A | | 7/1998 | Knight | |
| 5,787,606 A | | 8/1998 | Bokholdt | |
| D438,607 S | | 3/2001 | Edwards et al. | |
| 6,374,644 B1 | * | 4/2002 | Rhode et al. | 68/20 |
| 6,398,127 B1 | | 6/2002 | Wingo | |

FOREIGN PATENT DOCUMENTS

| | | |
|---|---|---|
| DE | 3727570 A1 | 3/1989 |
| DE | 4125138 A1 | 2/1993 |
| JP | 4-152992 | 5/1992 |
| JP | 4-285598 | 10/1992 |
| JP | 8-214959 | 8/1996 |
| JP | 11-28144 | 2/1999 |

* cited by examiner

*Primary Examiner*—Jiping Lu
(74) *Attorney, Agent, or Firm*—Diederiks & Whitelaw, PLC

(57) ABSTRACT

A laundry appliance includes a cabinet, a drying chamber, a door assembly, a blower assembly and an air passage for directing an airflow to the drying chamber. A media holder is removably positioned in the air passage to suspend a volatilizable media in the path of the airflow. The media holder includes a main body having rear wall formed from a latticework frame, an interior for receiving the volatilizable material, and a door member. The door member is also formed from a latticework frame. With this arrangement, both the rear wall and door member include a plurality of openings to allow an airflow to carry a fragrance or other substance from the volatilizable material through the air passage to treat clothes placed in the drying chamber.

33 Claims, 4 Drawing Sheets

VOLATILIZABLE MEDIA HOLDER FOR A LAUNDRY DRYER

BACKGROUND OF THE INVENTION

1. Field of the Invention

The present invention pertains to the art of laundry appliances and, more particularly, to a laundry dryer including a removable frame member for supporting a volatilizable material in an air flow for treating articles of clothing placed within the dryer.

2. Discussion of the Prior Art

In general, it is known to employ a volatilizable material, to treat articles of clothing contained within a conventional clothes dryer. There are several products on the market, such as BOUNCE, DRYEL and the like, that impart a fragrance, fabric softener, or the other substance to the articles of clothing. Typically, the volatilizable material, which takes the form of a fabric sheet or material web, is placed within the dryer and allowed to tumble and interact with the articles of clothing. With this arrangement, the combination of a heated airflow, contact with the articles of clothing and humidity causes the fragrance, softener or other substance to be transferred from the volatilizable material to the articles of clothing.

While these products are fine for a laundry appliance in the form of a tumble dryer, they would not be appropriate for use in a cabinet-type dryer. Cabinet dryers typically include a rod, such as that found in a typical clothes closet, from which articles of clothing are hung and exposed to a drying operation. Once placed in the cabinet, the articles of clothing do not move to any substantial degree and thus would not interact with the volatilizable material such that it would be difficult, if not impossible, to properly treat the articles of clothing. However, cabinet dryers are gaining in popularity as many consumers do not have the time to iron or make periodic trips to the dry cleaners. Clothes dried in a cabinet drier are less prone to wrinkling and, therefore, do not require ironing. However, unlike tumble dryers, the ability to impart a fresh fragrance to the clothes is rather limited.

The prior art also discloses a variety of holders for retaining a volatilizable material. One example is contained in U.S. Pat. No. 3,435,537 disclosing a door mounted apparatus for deodorizing or treating clothes in a tumble-type clothes dryer. The apparatus exposes a pellet or other chemical to a hot air stream circulated by both a rotary action of an inner tub and the articles of clothing tumbling within the inner tub. Another example, proposed U.S. Pat. No. 5,546,678, discloses a cabinet drier having a plurality of filters, including a charcoal filter, for filtering odors from the cabinet. These filters are arranged in hard-to-access locations, require periodic cleaning and are costly, not to mention that they do not lend themselves to transferring a fragrant material to clothing. In either case, the above described systems are not suitable for incorporation into a cabinet dryer to treat laundry with a fragrance or other substance.

Consumers have come to rely upon a variety of recognizable fragrances as a sign of cleanliness. Without the ability to transfer these recognizable fragrances to the clothing, consumers may come to believe that, for whatever reason, the clothes may not be as clean as they should. Therefore, providing a means of transferring a familiar fragrance to clothing placed in a cabinet dryer would increase the attractiveness of the appliance. In addition to imparting a fragrance to the clothes, there are products available that perform a dry cleaning process. The ability to take advantage of these products would further add to the utility and attractiveness of the appliance. Based on the above, there exists a need in the art for an improved holder for transferring a volatilizable material to articles of clothing that would allow a fragrance or the like to be carried to articles of clothing being dried in a laundry appliance, particularly a cabinet dryer.

SUMMARY OF THE INVENTION

The present invention is directed to a laundry appliance including a volatilizable media holder. More specifically, the laundry appliance includes a cabinet, a drying chamber, a door assembly, a blower assembly and an air passage for directing an airflow from the blower assembly to the drying chamber. Preferably, a media holder is removably positioned in the air passage. More preferably, the media holder suspends a volatilizable material in the airflow such that a fragrance or other substance is transferred to the drying chamber in order to treat clothes placed within the appliance.

In accordance with the most preferred form of the invention, the media holder includes a main body portion having a rear wall formed from a latticework frame, an interior portion for receiving the volatilizable material, and a door member. In a manner similar to that described for the rear wall, the door member is also formed from a latticework frame. With this construction, each of the rear wall and door member includes a plurality of openings to establish air passages through the media holder.

In further accordance with the most preferred embodiment, the media holder includes an exhaust bypass port arranged above the main body portion. The exhaust port allows an exhaust airflow to pass the media holder without impinging upon the volatilizable material. In addition, at least one guide element is provided on a side portion of the media holder to aid in aligning the media holder in the air passage. Finally, the media holder includes a handle to allow a consumer to easily remove and insert the media holder in the appliance.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
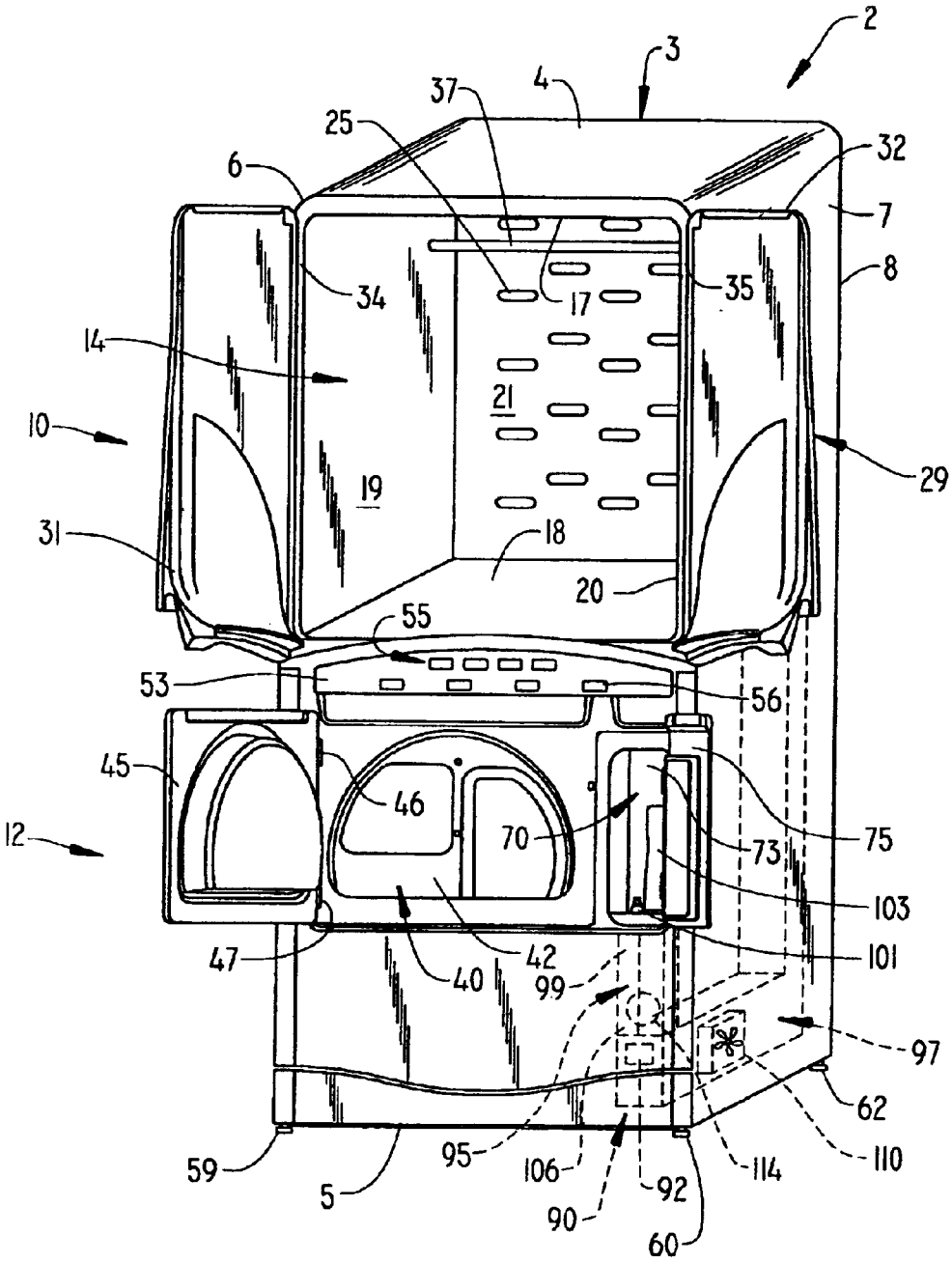
FIG. 1 is upper right perspective view of a laundry appliance including a media holder constructed in accordance with the present invention.

With initial reference to FIG. 1, a laundry appliance constructed in accordance with the present invention is generally indicated at 2. As shown, laundry appliance 2 includes a cabinet 3 having a top wall 4, a bottom wall 5, opposing side walls 6 and 7, and a rear wall 8. More specifically, laundry appliance 2 is actually a combination dryer including an upper dryer unit 10 and a lower dryer unit 12. In the embodiment shown, upper dryer unit 10 is constituted by a cabinet-type dryer including an upper drying chamber 14 having a top wall 17, a bottom wall 18, opposing side walls 19 and 20, and a rear wall portion 21. An array of air inlet ports, one of which is indicated at 25, is arranged about rear wall portion 21 to direct a drying airflow into upper drying chamber 14 to selectively perform a drying operation. Upper dryer unit 10 is also provided with an upper door assembly 29 having first and second door panels 31 and 32 pivotally mounted along respective edge portions 34 and 35 of cabinet 3. Door assembly 29 is adapted to provide access to upper drying chamber 14 to enable a consumer to introduce articles of clothing and the like for a drying operation. Finally, upper unit 10 is provided with at least one hanger rod 37 extending between side walls 19 and 20 for receiving articles of clothing, such as sheets, pants and the like, to be dried.

As indicated above, laundry appliance 2 is also provided with a lower dryer unit 12 which, in the embodiment shown, is constituted by a tumble-type dryer having a lower drying chamber 40 including a rotating inner drum 42. Lower dryer unit 12 is shown to include a door assembly 45 pivotally mounted through upper and lower hinges 46 and 47 to selectively provide access to lower drying chamber 40. As further shown in FIG. 1, laundry appliance 2 includes a control panel 53 arranged between upper and lower dryer units 10 and 12. In the embodiment shown, control panel 53 includes first and second rows of control buttons 55 and 56 for programming particular drying operations for upper and lower dryer units 10 and 12 respectively. Since the general programming and operation of laundry appliance 2 does not form part of the present invention, these features will not be discussed further here.

Laundry appliance 2 is adapted to be mounted upon a supporting surface, such as a laundry room floor. More specifically, a plurality of leg members, two of which are indicated in FIG. 1 at 59 and 60, extend from bottom portion 5 of cabinet 3 along side panels 6 and 7. Of course, corresponding leg members are also provided on the rear side of laundry appliance 2, one of which is indicated at 62. In any event, the various leg members 59, 60 and 62 are vertically adjustable to also act as levelers for laundry appliance 2. However, as such type of leg leveler arrangements are widely known in the art of appliances, including laundry appliances, ranges and refrigerators, the particular construction and function of leg members 59, 60 and 62 does not form part of the present invention and therefore will not be discussed further herein.

Laundry appliance 2 further includes an auxiliary compartment 70 which, in the embodiment shown, is positioned adjacent to lower dryer unit 12. Auxiliary compartment 70 includes an interior portion 73 and is provided with a door 75. In accordance with a preferred form of the present invention, an air delivery system, generally indicated at 90, is arranged below auxiliary compartment 70. More specifically, air delivery system 90 includes an air inlet 92, a flow or return duct 95 and a hot air duct 97 adapted to circulate a drying airflow within upper dryer unit 10. In the embodiment shown, duct 95 includes a first end 99 which, as will be detailed more fully below, is adapted to receive a media frame 101 which is removably positioned adjacent a water bottle 103. First end 99 of duct 95 leads to a second end 106 which is in fluid communication with hot air duct 97. Hot air duct 97 is in fluid communication with air inlet ports 25. The drying airflow enters upper drying chamber 14 through air inlet ports 25, passes through clothing on hanger rod 37, and then enters return duct 95. Actually, a plurality of wax motor operated dampers (not shown) are preferably employed to recirculate all of the drying airflow or, alternatively, allow a portion of the airflow to be exchanged with room air as determined by appliance settings established through control panel 53. As further shown in FIG. 1, a blower 110 is positioned in hot air duct 97 for generating the drying airflow. In the embodiment shown, blower 110 is constituted by a bladed fan mounted for rotation in a housing (not separately labeled). However, it should be understood that blower 110 could also take the form of a squirrel cage type blower mounted in a housing integrally formed with duct 95. Finally, laundry appliance 2 is provided with an outlet vent 114 that enables a percentage of the drying airflow to be exhausted from appliance 2 after passing through upper drying chamber 14. In a preferred embodiment, with the dampers (not shown) open, approximately 70% of the airflow is recirculated, while the remaining portion is exchanged for fresh air that is introduced from the surrounding room.

Figure 2:
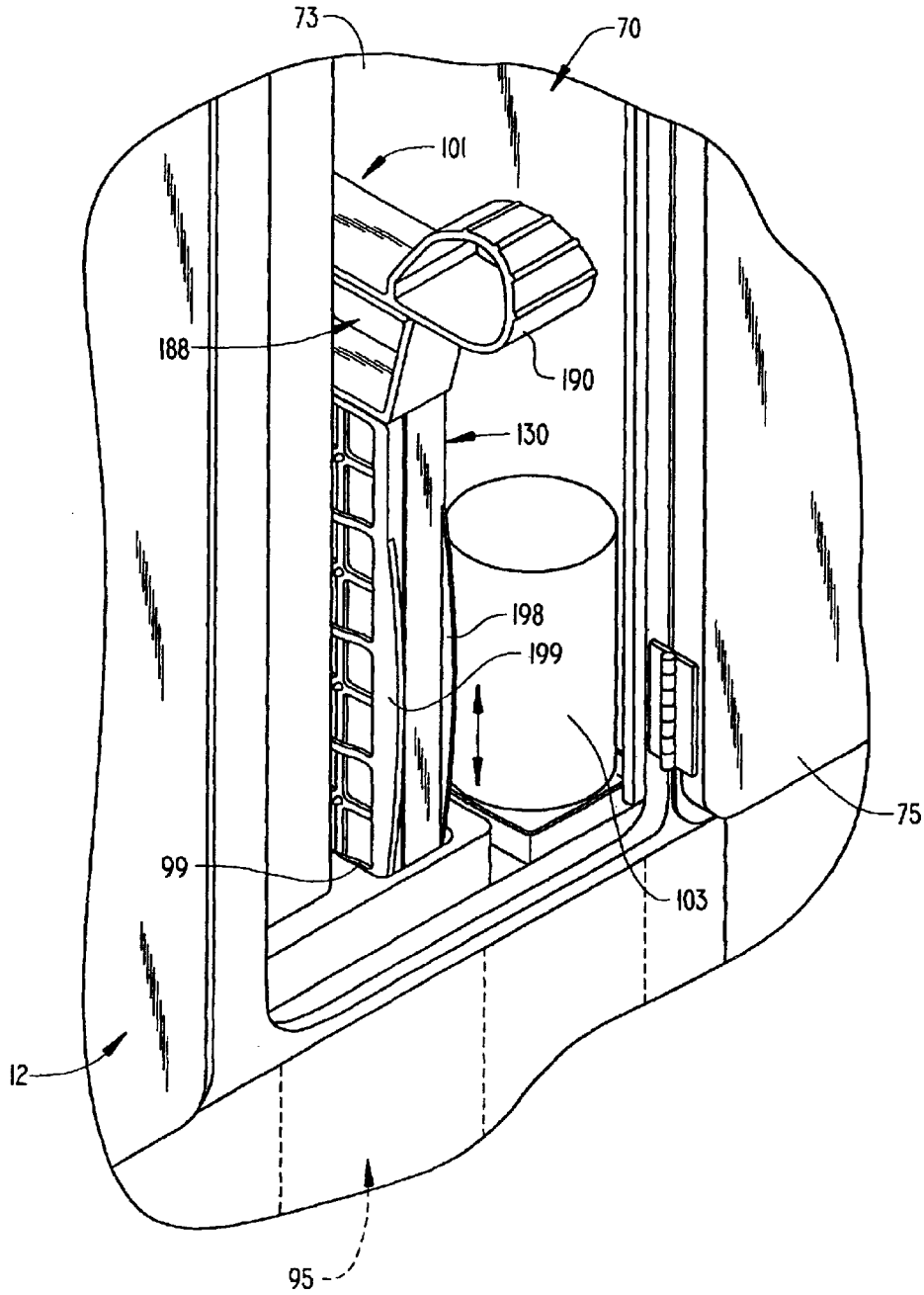
FIG. 2 is a partial perspective view showing the media holder partially extending into an air passage of the laundry appliance.
Figure 3:
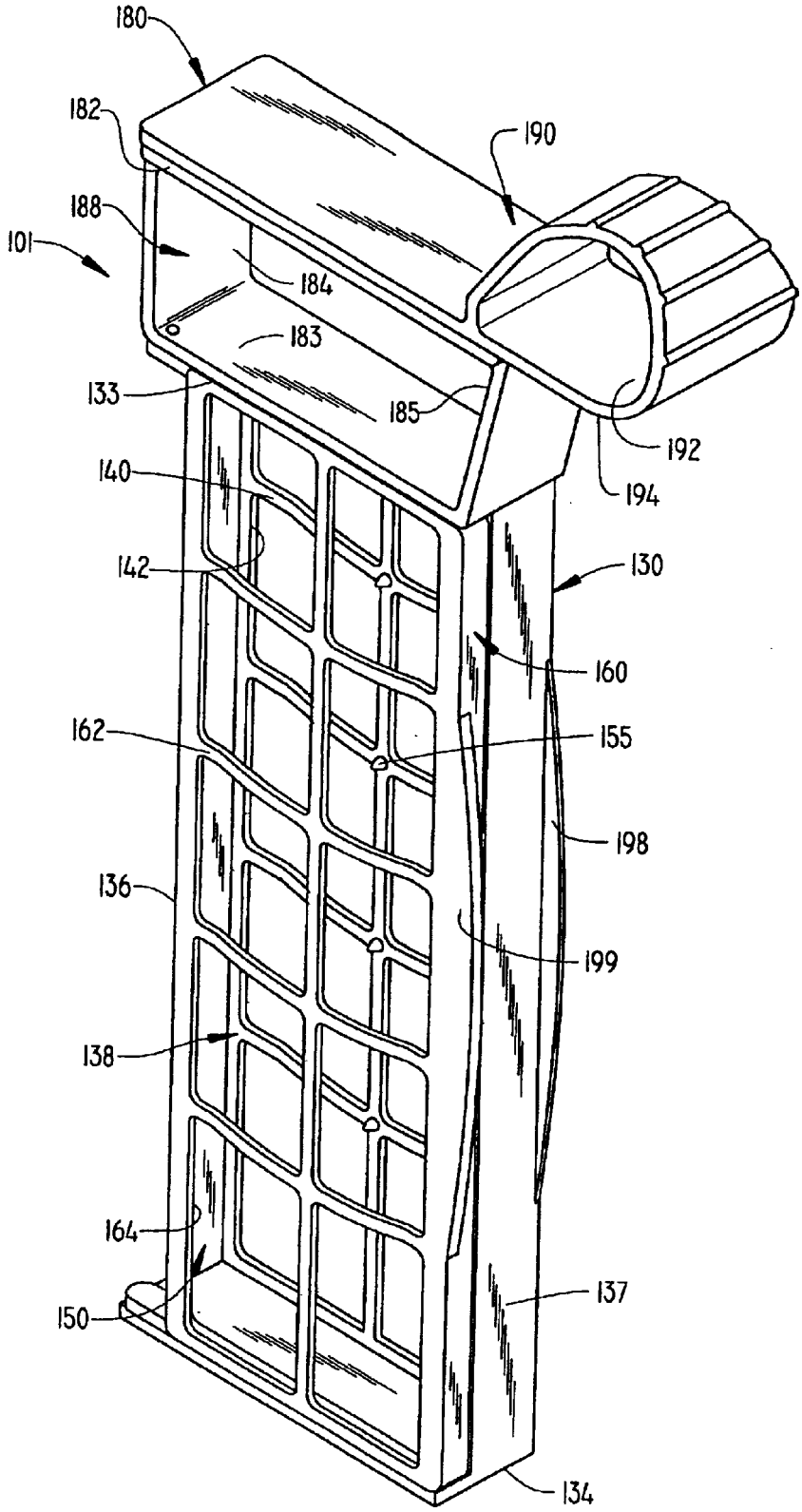
FIG. 3 is a perspective view of the media holder of FIG. 2.
Figure 4:
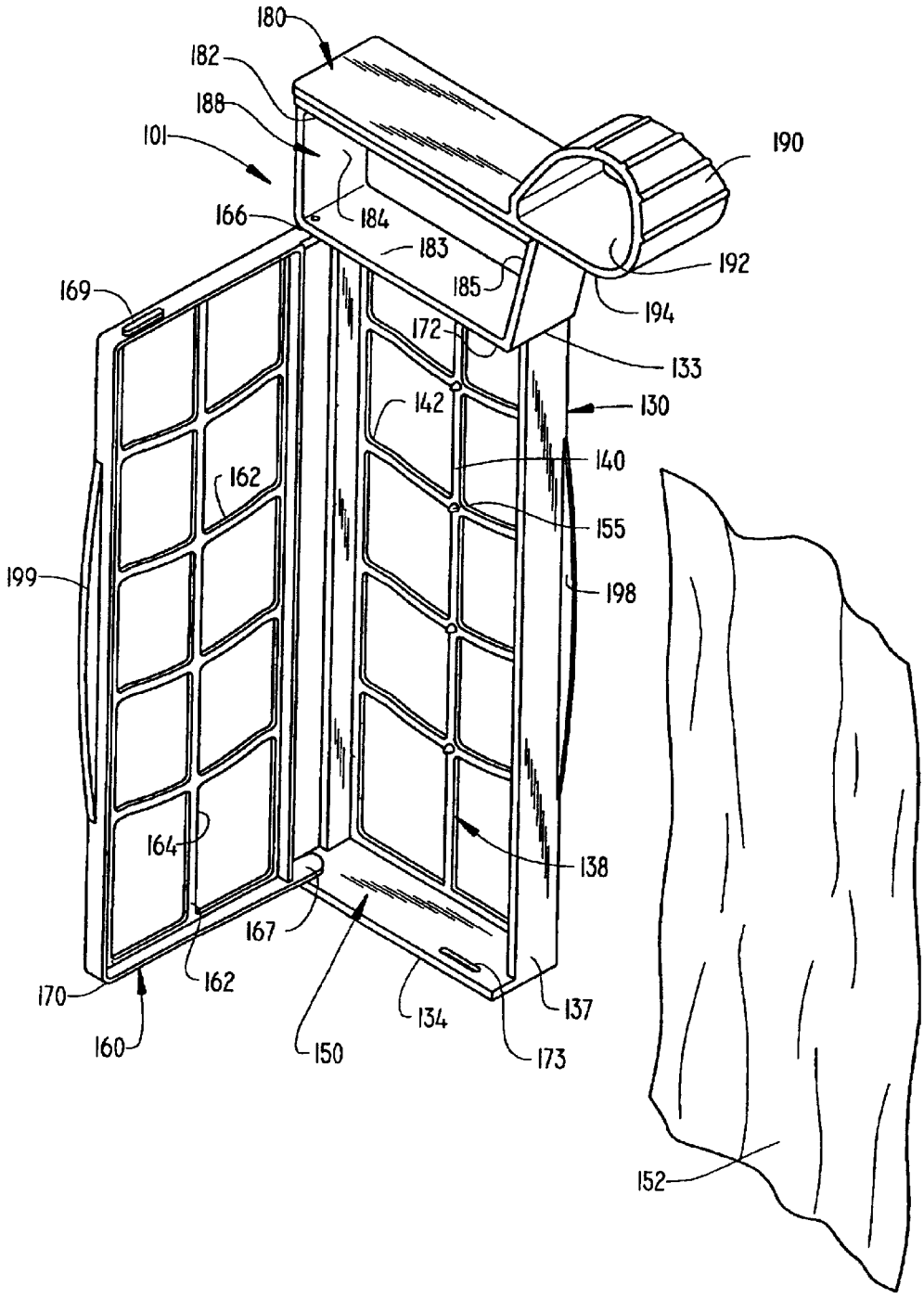
FIG. 4 is a perspective view of the media holder of FIG. 3 showing an open door member and a volatilizable material sheet.

The above-described structure has been presented for the sake of completeness and to provide a better understanding of the present invention which is particularly directed to the particular structure and use of media frame 101. Referring to FIGS. 2–4, media frame 101 includes a main body portion 130 having top 133, bottom 134, opposing side 136 and 137, and rear 138 wall portions. In accordance with the most preferred form of the invention, rear wall portion 138 is constituted by a latticework frame 140 having a plurality of openings or air channels, one of which is indicated at 142. Wall portions 133–138 define, at least in part, an interior portion 150 of main body portion 130. In further accordance with the most preferred form of the invention, interior portion or chamber 150 is adapted to receive a volatilizable material 152 (see FIG. 4) such as a dryer sheet, scented pad, or other type of medium used in a drying operation. To this end, rear wall 138 is preferably provided with a plurality of retaining elements or projections, one of which is indicated at 155, to removably support volatilizable material 152 within interior portion 150.

In the preferred form, media frame 101 is also provided with a door member 160. In a manner similar to that described for rear wall portion 138, door member 160 includes a latticework frame 162 having a plurality of openings or air channels, one of which is indicated at 164. More preferably, air channels 164 are arranged opposite air channels 142 on rear wall portion 138 to provide a direct air passage through main body portion 130 and, correspondingly, volatilizable material 152. In any event, door member 160 is pivotally mounted to main body portion 130 through upper and lower hinge elements 166 and 167 and is provided with upper and lower latching projections 169 and 170. Latching projections 169 and 170 are adapted to engage and rest with corresponding upper and lower latching receivers 172 and 173 (see FIG. 4) formed in main body portion 130. With this construction, door member 160 can selectively be retained in a closed position. In the most preferred form of the invention, media frame 101 is molded entirely of plastic, with door member 160 being snap-fit to main body portion 130.

Media frame 101 is also provided with an upper frame portion 180 which is integrally molded with top portion 133. As shown, upper frame portion 180 includes a top member 182, bottom member 183, and opposing side members 184 and 185. Actually, top, bottom, and opposing side members 182–185 combine to form a bypass port 188 which, during select portions of a drying operation, allows an exhaust airflow to pass through media frame 101 without impinging upon volatilizable material 152. In further accordance with the most preferred form of the invention, a handle 190, which is shown to take the form of a loop, is provided upon top member 182 of upper frame portion 180. Handle 190 includes an interior portion 192 which enables a consumer to readily insert/remove media frame 101 from duct 95. Handle 190 further includes bottom portion 194 which partially supports media frame 101 in first end 99 of duct 95. Finally, media frame 101 is provided with a pair of tapered guide elements 198 and 199 which facilitate the insertion and alignment of main body portion 130 within duct 95.

With this construction, during select portions of a drying operation, the drying airflow passes through air channels 142 and 164 of media frame 101, while picking up a fragrance or other substance embodied in the volatilizable material 152. Preferably, media frame 101 is placed in return duct 95 in a manner that forces an airflow through volatilizable material 152. However, media frame 101 may also be placed in return duct 95 in a manner that permits the airflow to come in contact with each side of volatilizable material 152. The drying airflow is actually humidified through interaction with water contained within water bottle 103 before passing into return duct 95 and ultimately to upper drying chamber 14. In any event, the drying airflow carries the volatilizable substance into upper drying chamber 14 at which point the airflow passes over clothes and other items placed in upper chamber 14. In this manner, the consumer can selectively treat laundry items with a desired fragrance, softener, or dry clean treatment using readily available consumer products.

Although described with reference to a preferred embodiment of the present invention, it should be readily apparent of one of ordinary skill in the art that various changes and/or modifications can be made to the invention without departing from the spirit thereof. For instance, while the present invention is described as being used in conjunction with a dryer cabinet, the media frame could be easily adapted to also operate with the tumble portion of the appliance. In addition, while the laundry appliance is described as being a combination dryer cabinet/tumble dryer, the present invention can be employed in various dryer appliances. Furthermore, while the volatilizable material is depicted as a fabric sheet, it should be understood that a variety of other materials, such as mesh bags filled with a volatilizable medium and scented filter pads, would also be acceptable. In general, the invention is only intended to be limited to the scope of the following claims.

We claim:

1. A laundry appliance comprising:

a cabinet including top, bottom, rear and opposing side walls;

a drying chamber arranged within the cabinet, said drying chamber being adapted to receive articles of clothing to undergo a drying process;

a door assembly pivotally mounted to the cabinet for selectively sealing the drying chamber;

a blower assembly mounted within the cabinet, said blower assembly generating a drying airflow;

an air passage for directing the drying airflow into the drying chamber; and a media holder assembly removably positioned in the air passage including:

a main body portion including top, bottom, opposing side and rear wall portions defining an interior chamber, said main body portion including a latticework frame having a plurality of openings;

a door member connected to the main body portion, said door member being formed from a latticework frame having a plurality of openings, said door member being adapted to selectively retain a volatilizable material within the interior chamber of the main body portion wherein, when the media holder assembly is positioned in the air passage, the drying airflow passes through the interior chamber to the drying chamber; and a bypass port which permits at least a portion of the drying airflow to pass through the media holder without passing through the interior chamber.

2. A laundry appliance comprising:

a cabinet including top, bottom, rear and opposing side walls;

a drying chamber arranged within the cabinet, said drying chamber being adapted to receive articles of clothing to undergo a drying process;

a door assembly mounted to the cabinet for selectively sealing the drying chamber;

a blower assembly mounted within the cabinet, said blower assembly generating a drying airflow;

an air passage for directing the drying airflow into the drying chamber; and a media holder assembly removably positioned in the air passage including:

a main body portion including top, bottom, opposing side and rear wall portions defining an interior chamber, said main body portion including a latticework frame having a plurality of openings; and a door member connected to the main body portion, said door member being formed from a latticework frame having a plurality of openings, said door member being adapted to selectively retain a volatilizable material within the interior chamber of the main body portion wherein, when the media holder assembly is positioned in the air passage, the drying airflow passes through the interior chamber to the drying chamber.

3. The laundry appliance according to claim 2, wherein the media holder assembly includes a handle element for positioning the main body portion relative to the air passage.

4. The laundry appliance according to claim 2, wherein the media holder assembly includes at least one guide element aligning the main body portion within the air passage.

5. The laundry appliance according to claim 4, wherein the at least one guide element extends along a side portion of the door member.

6. The laundry appliance according to claim 2, wherein the media holder assembly includes a plurality of retaining elements projecting from the latticework frame of the main body portion for holding a volatilizable material within the interior chamber.

7. The laundry appliance according to claim 2, wherein the door member includes means for releasably latching the door member to the main body portion.

8. The laundry appliance according to claim 2, wherein the laundry appliance is constituted by a dryer cabinet.

9. The laundry appliance according to claim 8, wherein the door assembly includes first and second door members.

10. The laundry appliance according to claim 8, further comprising: a hanger rod extending between the opposing side wall portions, said hanger rod being adapted to support clothes items to be dried within the cabinet.

11. The laundry appliance according to claim 10, further comprising: a plurality of air inlet ports arranged about the rear wall of the cabinet, said plurality of air inlet ports being adapted to direct the drying airflow onto clothes items hung from the hanger rod.

12. The laundry appliance according to claim 8, wherein the dryer cabinet is mounted above a tumble dryer.

13. The laundry appliance according to claim 2, wherein the door member is pivotally connected to the main body portion.

14. A laundry appliance comprising:

a cabinet including top, bottom, rear and opposing side walls;

a drying chamber arranged within the cabinet, said drying chamber being adapted to receive articles of clothing to undergo a drying process;

a door assembly pivotally mounted to the cabinet for selectively sealing the drying chamber;

a blower assembly mounted within the cabinet, said blower assembly generating a drying airflow;

an air passage for directing the drying airflow into the drying chamber; and a media holder assembly removably positioned in the air passage including:

a main body portion including top, bottom, opposing side and rear wall portions defining an interior chamber, said main body portion including a latticework frame having a plurality of openings, wherein a volatilizable material is adapted to be selectively retained within the interior chamber of the main body portion such that, when the media holder assembly is positioned in the air passage, the drying airflow passes through the interior chamber to the drying chamber; and a bypass port which permits at least a portion of the drying airflow to pass through the media holder without passing through the interior chamber.

15. The laundry appliance according to claim 14, wherein the media member includes a handle element for positioning the media holder relative to the air passage.

16. The laundry appliance according to claim 14, wherein the media holder assembly includes at least one guide element aligning the main body portion within the air passage.

17. The laundry appliance according to claim 16, wherein the at least one guide element extends along a side portion of the door member.

18. The laundry appliance according to claim 14, wherein the media holder assembly includes a plurality of retaining elements projecting from the latticework frame of the main body portion for holding a volatilizable material within the interior chamber.

19. The laundry appliance according to claim 14, wherein the media holder assembly further includes a door member connected to the main body portion, said door member being formed from a latticework frame having a plurality of openings.

20. The laundry appliance according to claim 19, wherein the door member includes means for releasably latching the door member to the main body portion.

21. The laundry appliance according to claim 14, wherein the laundry appliance is constituted by a dryer cabinet.

22. The laundry appliance according to claim 21, wherein the door assembly includes first and second door members.

23. The laundry appliance according to claim 21, further comprising: a hanger rod extending between the opposing side wall portions, said hanger rod being adapted to support clothes items to be dried within the cabinet.

24. The laundry appliance according to claim 23, further comprising: a plurality of air inlet ports arranged about the rear wall of the cabinet, said plurality of air inlet ports being adapted to direct the drying airflow onto clothes items hung from the hanger rod.

25. The laundry appliance according to claim 21, wherein the dryer cabinet is mounted above a tumble dryer.

26. The laundry appliance according to claim 14, wherein the door member is pivotally connected to the main body portion.

27. A volatilizable media holder assembly adapted to be removably placed in an air passage of a laundry dryer having a drying chamber comprising:

a main body portion including top, bottom, opposing side and rear wall portions defining an interior chamber, said main body portion including a latticework frame having a plurality of openings; and a door member connected to the main body portion, said door member being formed from a latticework frame having a plurality of openings, said door member being adapted to selectively retain a volatilizable material within the interior chamber of the main body portion, wherein a drying airflow is adapted to pass through the interior chamber when the media holder assembly is positioned in an air passage of a laundry dryer; and a bypass port which permits at least a portion of the drying airflow to pass through the media holder without passing through the interior chamber.

28. The volatilizable media holder according to claim 27, wherein the door member is pivotally connected to the main body portion.

29. The volatilizable media holder according to claim 27, further comprising: a handle element for positioning the media holder assembly relative to the air passage.

30. The volatilizable media holder according to claim 27, further comprising: at least one guide element for aligning the media holder assembly within an air passage of a dryer.

31. The volatilizable media holder according to claim 30, wherein the at least one guide element extends along a side portion of the door member.

32. The volatilizable media holder according to claim 27, further comprising: a plurality of retaining elements projecting from the latticework frame of the main body portion for holding a volatilizable material within the interior chamber.

33. The volatilizable media holder according to claim 27, wherein the door member includes means for releasably latching the door member to the main body portion.

* * * * *